United States Patent [19]

Lind

[11] 4,187,645

[45] Feb. 12, 1980

[54] REACTIVE SYSTEM FOR ACCOMMODATING BELT STRETCH AND TRACKING

[75] Inventor: Fred W. Lind, Osseo, Minn.

[73] Assignee: Timesavers, Inc., Minneapolis, Minn.

[21] Appl. No.: 928,173

[22] Filed: Jul. 26, 1978

[51] Int. Cl.[2] ..... B24B 21/18

[52] U.S. Cl. ..... 51/135 BT

[58] Field of Search ..... 51/135 R, 135 BT, 142; 198/809; 74/241

[56] References Cited

U.S. PATENT DOCUMENTS

| | | | |
|---|---|---|---|
| 2,701,430 | 2/1955 | Lorig | 51/135 R |
| 2,733,555 | 2/1956 | Dugle et al. | 51/135 BT |
| 3,363,366 | 1/1968 | Estabrook | 51/135 BT |
| 3,447,306 | 6/1969 | Jakimcius | 51/135 BT |
| 3,504,458 | 4/1970 | Rutt | 51/135 BT |
| 3,552,067 | 1/1971 | Przygocki | 51/135 BT |
| 3,577,684 | 5/1971 | Jakimcius | 51/135 BT |
| 3,665,650 | 5/1972 | Przygocki | 51/135 BT |
| 3,691,698 | 9/1972 | Schaller | 51/135 R |
| 3,745,717 | 2/1971 | Robinson | 51/135 BT |
| 3,900,973 | 8/1975 | van der Linden | 51/135 BT |
| 3,971,166 | 7/1976 | Habeck et al. | 51/135 BT |
| 4,043,083 | 8/1977 | Rosdil | 51/135 BT |

*Primary Examiner*—Harold D. Whitehead

*Assistant Examiner*—K. Bradford Adolphson

*Attorney, Agent, or Firm*—Orrin M. Haugen; Thomas J. Nikolai

[57] ABSTRACT

An improved tracking system for belt-type abrading machines, particularly wide belt machines which employ a drive roll together with a belt tensioning and tracking roll. As is conventional, the tensioning and tracking roll is mounted upon a rocker arm providing for pivotal motion of the roll about its axis, and with the pivot axis of the rocker arm being located generally midway between the lateral ends of the roll. The system employs a primary and a secondary tracking driver, with the primary tracking driver being a conventional system responsive to the belt position sensor, and with the secondary tracking driver being responsive, on a time delay basis, to the drive motion activity of the primary tracking driver. The primary tracking driver is ordinarily a fluid actuated piston member which responds to signals from the belt position sensor, with the secondary tracking driver being a gear motor which drives a worm gear for adjustably repositioning the rocker arm supporting the tensioning and tracking roll. The arrangement accommodates both belt wear and belt stretch, and extends the lifetime of endless abrasive belts.

1 Claim, 8 Drawing Figures

REACTIVE SYSTEM FOR ACCOMMODATING BELT STRETCH AND TRACKING

BACKGROUND OF THE INVENTION

The present invention relates generally to a tracking means for a belt-type abrading machine, and more specifically to an endless belt tracking system which accommodates belt stretch and belt wear and thus extends the useful life of such devices.

Belt-type abrading machines are known and used in the art for treatment of a variety of materials including wood as well as metals. Both grinding and finishing operations may be undertaken with either wood or metals. The abrasive belts, as is appreciated, are subject to substantial forces during abrading operations, and as such become stretched across the lateral extent thereof. When the stretch is uniform throughout the width of the belt, there is no adverse affect upon the ability of the belt to track, however such uniform stretch does not normally occur in practice. Non-uniform stretching results in the formation of anomalous belt configurations wherein the belts become conical rather than remaining cylindrical. Tracking becomes more difficult with abrasive belts having such anomalous configurations.

In the belt-type abrading machines in current use, two types of sensing and tracking systems are employed, the first being position sensing, the second being force-sensing. In position sensing operations, the belt remains in a substantially fixed axial or lateral disposition, subject to repositioning whenever the belt moves laterally outwardly of predetermined limit positions. In force-sensing, means are provided to cause the belt to respond to forces about the center point, with such sensing normally being desired to both extend the useful life of the belt and to provide more uniform wear across the surface of the abrasive belt. The tracking system of the present invention is primarily applicable to position sensing.

In the past, a variety of sensing systems have been developed and utilized, with one typical belt position sensor being disclosed and described in U.S. Pat. No. 3,971,166, as well as in U.S. Pat. No. 3,504,458. A control system for belt tracking is also disclosed in U.S. Pat. No. 3,118,314. In each of these systems, the endless belt is maintained within a predetermined path by selectively tilting or rocking the axis of a tensioning and tracking roll, with various means being applied to accomplish the tilting.

In each of these prior art systems, means are provided for angular adjustment of the tracking roll, with the Rutt Pat. No. 3,504,458 illustrating a force tracking system for accommodating angular adjustment or rocking of a tracking roll when a certain predetermined limit position has been reached. The tracking system of the present invention differs from that of U.S. Pat. No. 3,504,458 in that a generally continuous angular or arcuate adjustment and control of the tracking roll, with primary and secondary tracking drivers being employed, the primary driver being responsive to means detecting the immediate position of the belt and with the secondary driver being responsive to the integral of time that is required for the primary driver to adjustably drive the belt in either lateral direction. The time integration of the system may be readily accomplished by interposing a time-delay between the actuation of the primary belt tracking driver and the actuation of the secondary belt tracking driver and time-delay relays may be employed for this purpose.

SUMMARY OF THE INVENTION

Briefly, in accordance with the present invention, an abrasive belt tracking system is provided which utilizes a primary sensor for determining the lateral or axial position of an endless abrasive belt, with a primary belt tracking driver being responsive to the primary sensor. Tracking means are provided for centering the belt in either direction, that is, for centering the belt to the left, or centering the belt to the right. A secondary belt tracking driver is provided which operates to adjust the position of the tracking belt in response to the activity of the primary driver. Specifically, a time-delay network is employed so that the secondary belt tracking driver will initiate a correction or repositioning operation only after a predetermined continuous time period has elapsed during which the primary belt tracking driver has been continuously energized. The repositioning or adjustable positioning of the tracking roll by the secondary belt tracking driver effects more uniform and continuously controllable tracking for the primary driver. The secondary belt tracking driver is one which provides a firm and steady support base which is free of gear backlash position hunting, or the like. More uniform belt wear occurs with the present system.

Therefore, it is a primary object of the present invention to provide an improved tracking system for endless abrasive belts which accommodates for anomalous belt wear, by establishing an intermittent repositioning of the tracking roll, dependent upon the extent and direction of tracking activity required.

It is a further object of the present invention to provide an improved tracking system for endless abrasive belts which utilizes a primary sensor, along with a primary belt tracking driver responsive to the primary sensor, and which additionally utilizes a secondary belt tracking driver which is responsive to the extent and direction of control required by the primary driver in maintaining belt position.

It is a further object of the present invention to provide an improved tracking system for endless abrasive belts which utilizes a primary belt tracking driver for maintaining and achieving substantially instantaneous repositioning of the belt laterally of the rolls, along with a secondary belt tracking driver which functions to intermittently reposition or adjust the axis of the tracking roll.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
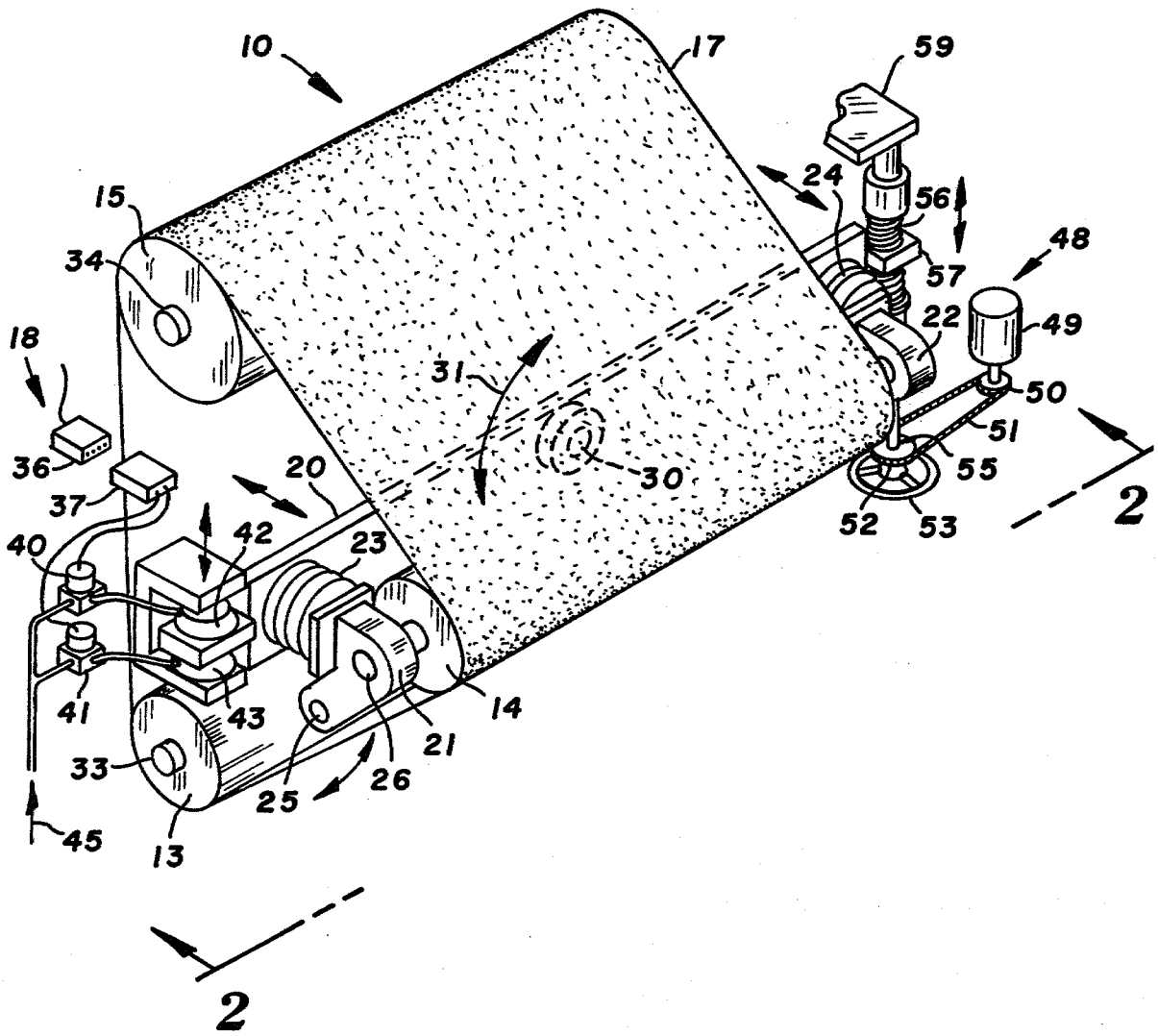
FIG. 1 is a perspective view of a grinding head including the rolls normally utilized in a typical belt-type abrading machine, with the apparatus being provided with the improved belt tracking system of the present invention.
Figure 2:
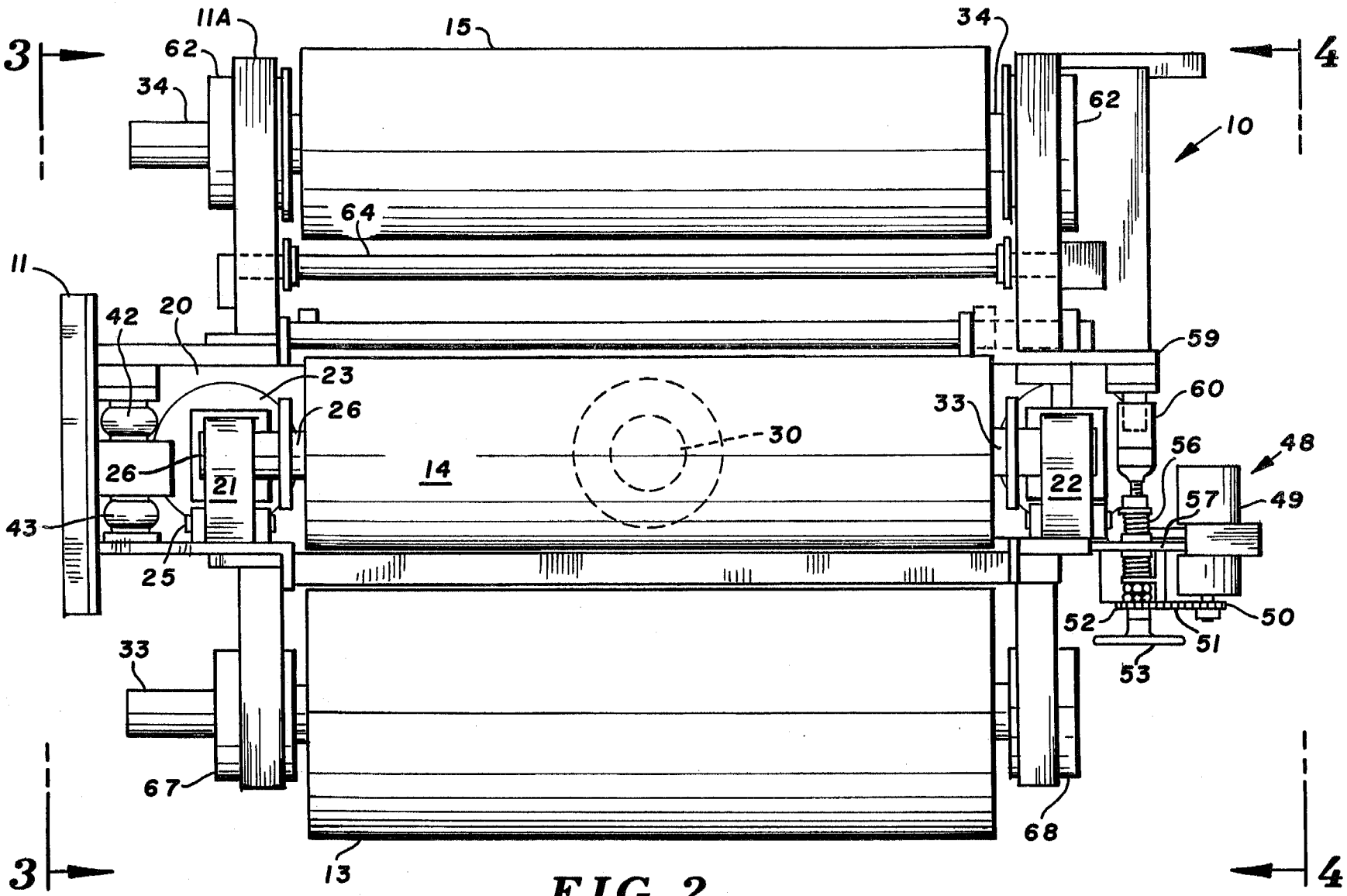
FIG. 2 is a view taken along the line and in the direction of the arrows 2—2 of FIG. 1, with this figure illustrating, in plan view, the belt and roll portions of a belt-type abrading machine.
Figure 4:
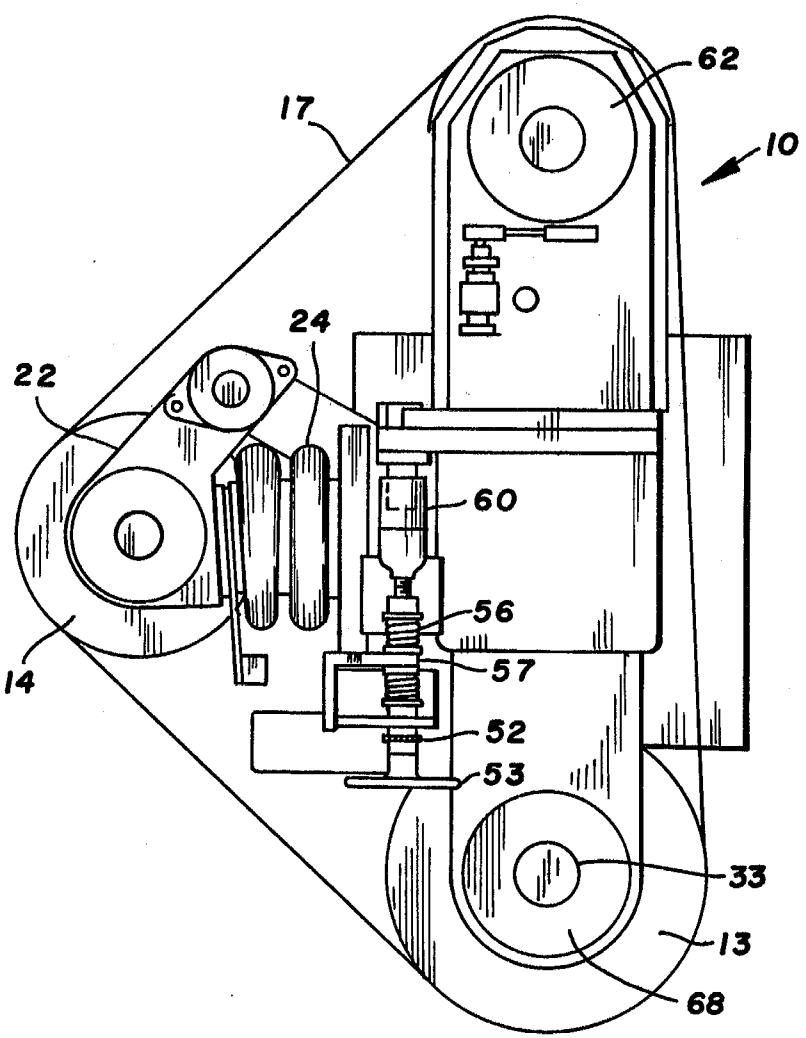
FIG. 4 is a vertical sectional view taken along the line and in the direction of the arrows 4—4 of FIG. 2, and illustrating the end of the apparatus opposed from that shown in FIG. 3.
Figure 3:
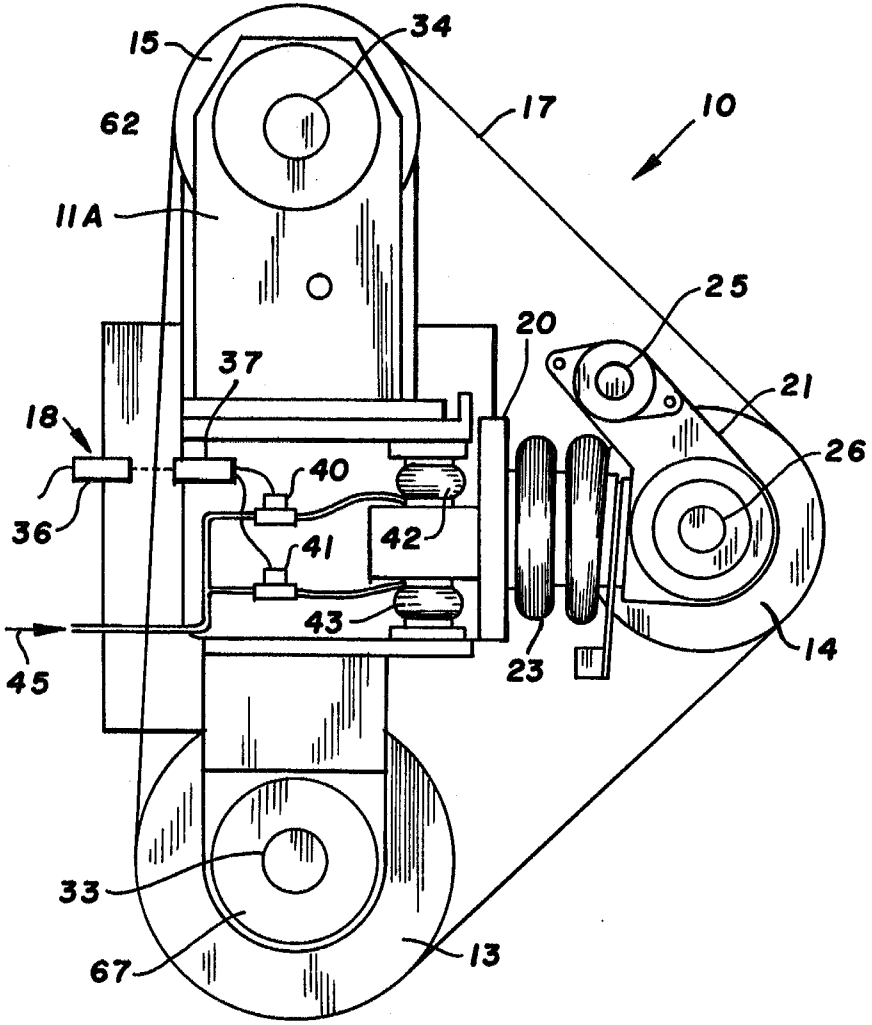
FIG. 3 is a vertical sectional view taken along the line and in the direction of the arrows 3—3 of FIG. 2, and illustrating, generally, an end view of the belt and roll portions of a belt-type abrading machine in accordance with the present invention.

In accordance with the preferred embodiment of the present invention, and with particular attention being directed to FIGS. 1 and 2 of the drawings, the belt-type abrading machine head generally designated 10 includes frame means 11 in the form of side panels and other supports including means for supporting the individual rolls. Again, reference may be made to those belt-type abrading machines disclosed in U.S. Pat. No. 3,888,050; 3,832,808; 3,893,265; as well as U.S. Pat. No. 3,504,458. The head 10 is adapted for use in an apparatus such as shown in U.S. Pat. No. 3,888,050. Essentially, each of the prior art structures utilizes at least two rolls, and normally three rolls, one of which is a tensioning and tracking roll, the axis of which is pivotally adjustable. With continued attention being directed to FIGS. 1 and 2, the belt-type abrading machine employs a drive roll 13 along with a tension and tracking roll 14. A contact roll or drum 15 is provided which is utilized for making contact with the surface of the work. As can be appreciated, and for purposes of simplicity, the illustration of FIG. 1 illustrates a bottom unit, that is, one having the work surface at the upper peripheral area of contact roll or drum 15. A top unit will be merely an inverted version of the bottom unit illustrated. An endless abrasive belt is trained about the rolls, with the belt being shown at 17, the edge of which is disposed between a primary sensor means illustrated as at 18.

Tension and tracking roll 14 is mounted within a yoke comprising rocker support arm 20 along with a pair of oppositely disposed bell cranks 21 and 22 which, when actuated by the force from air bags 23 and 24 respectively act to pivot about shaft 25 to adjustably position roll axis 26 to control belt tension. Normally, belt tension may be controlled by having a supply of compressed air or fluid at a relatively constant pressure available within the confines of air bags 23 and 24. These air bags are, of course, commercially available and are, briefly stated, air supported "pillows" which provide a firm but resilient support, frequently capable of isolating vibratory forces from one point to another.

With continued attention being directed to FIGS. 1 and 2, rocker support arm 20 is shown mounted upon a shaft 30 for pivotal motion about the axis thereof. Motion of support arm 20 is accordingly capable of being undertaken in accordance with double-headed arrow 31.

Driver roll 13 and contact roll 15 are journalled for rotation within frame 11 about central shafts 33 and 34 respectively. Suitable bearings are, of course, provided, with a source of rotary motion being coupled to drive roll 13 to achieve an orbital motion of belt 17 about rolls 13, 14 and 15.

Primary sensor 18, as illustrated, is a typical light-emitting diode sensor system which employs four such devices along with four corresponding receivers. The light-emitting diodes are contained within envelope or enclosure 37. It is important to recognize that the system of the present invention is applicable to any of a variety of primary sensors, including the light-emitting diode sensors, conventional light-photocell devices, pneumatic systems such as illustrated in U.S. Pat. No. 3,971,166, as well as edge detecting or feeler systems. It is only important to recognize and realize that the primary sensor must be one which is capable of generating a signal which indicates that it has moved beyond a predetermined lateral or axial limit. It is also indicated that belt position sensors of the light-emitting diode type, the lamp-photocell combinations, as well as the pneumatic systems are all in use and are commercially available. The light-emitting diode sensor system is illustrated here for illustrative reasons only, it being appreciated that the system is equally adapted for virtually any type of primary sensor.

In the system illustrated, the sensor system 18 utilizes a receiver which, coupled through an amplifier (not shown) delivers a signal to solenoid valves 40 and 41 for permitting a flow of compressed fluid to selectively enter piston elements 42 and 43 respectively. As can be appreciated, solenoid valves 40 and 41 are coupled to a source of compressed air, as indicated at 45, and upon receiving a signal from sensor receiver 37, will permit the selective opening of either valve 40 or 41, and the consequential flow of compressed air or other fluid into the appropriate piston element. Following the introduction of compressed fluid into the piston 42 and 43, the belt 17 is caused to move laterally and thus "track" to a predetermined location, at which point further transverse motion ceases, such as when the sensor system 18 detects that the belt has moved to a position within the desirable tracking area. While the belt is within the desirable area, a substantially equal pressure is normally maintained between pistons 42 and 43, thereby maintaining a substantially horizontal disposition for rocker support arm 20, and consequent steady or controllable orbital motion of belt 17.

Figure 6:
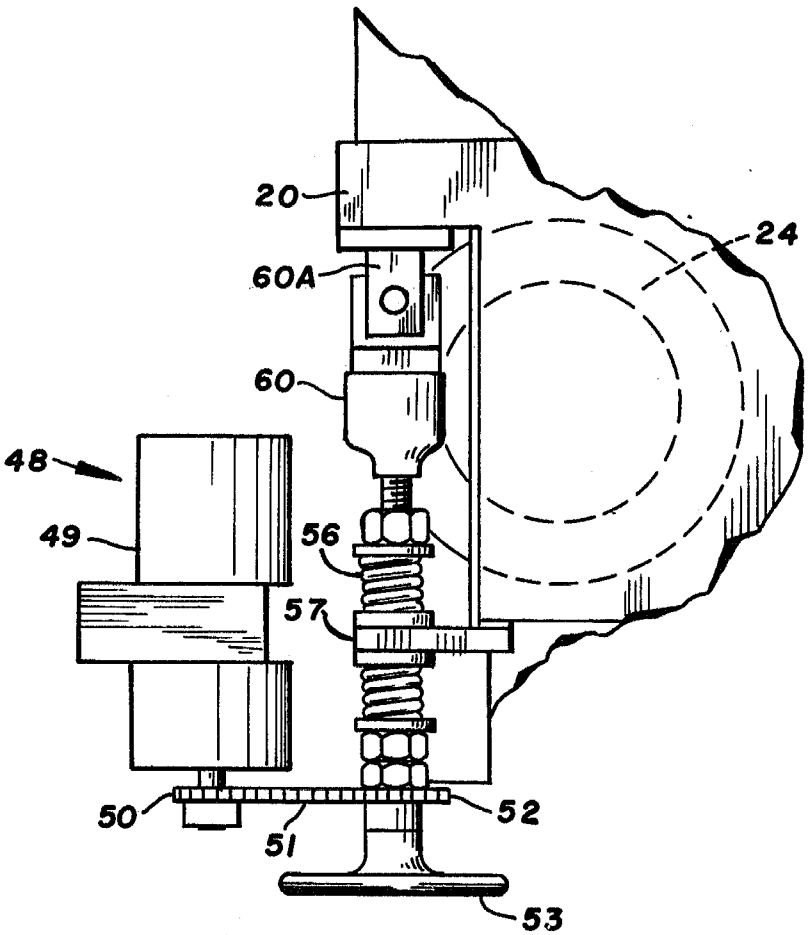
FIG. 6 is a detail fragmentary rear elevational view similar to FIG. 5, with a view being taken from the right of FIG. 4.
Figure 5:
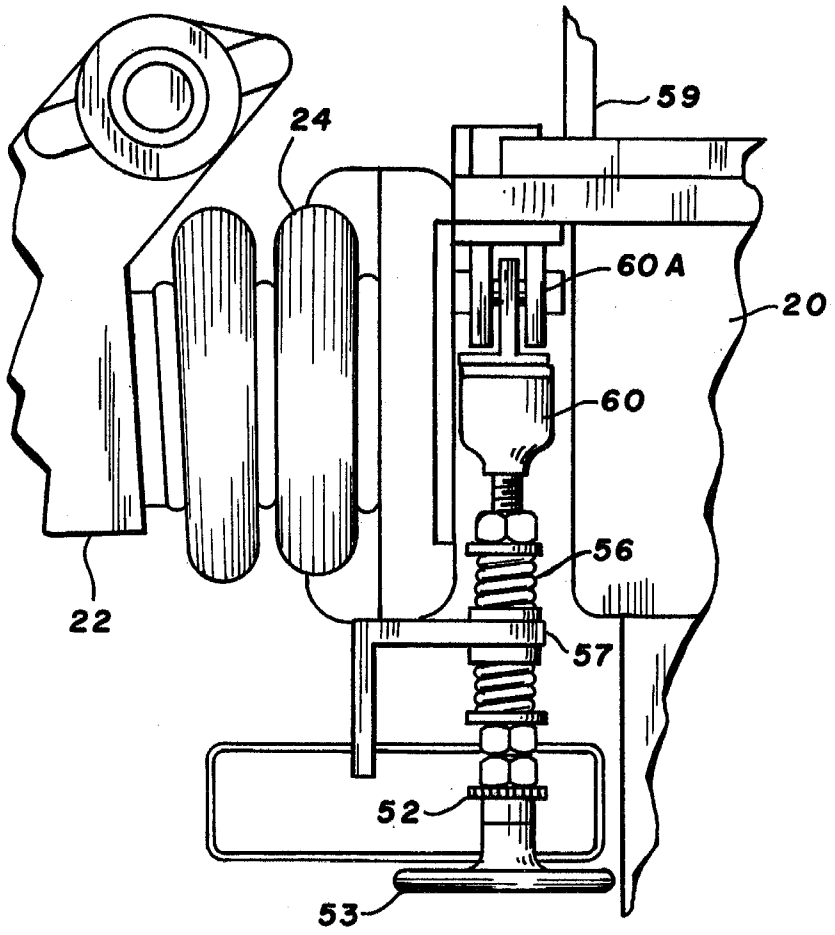
FIG. 5 is a fragmentary front elevational view of the secondary belt tracking driver, shown in FIG. 4, and illustrating certain of the details of the structure in slightly enlarged scale.

Secondary belt tracking drive means are illustrated generally at 48, with the secondary system including gear motor 49 which is capable of driving sprocket 50 in either rotational direction. Sprocket 50 engages chain 51 which, in turn, rotates driven sprocket 52 as desired. Hand wheel 53 is provided for overriding the motion of gear motor 49, with sprocket 52 being fast on shaft 55. Shaft 55 is provided with a pair of Danly compression springs, the upper one being shown at 56, which are in contact with adjustment lug or bracket 57, which is attached to arm 20. Shaft 55 is threadedly engaged with an internally threaded bore in cup 60, and hence rotation of shaft 55 will be reflected by raising or lowering of bracket 57 within springs 56—56, thereby adjustably positioning the rocker support arm 20 about the axis of shaft 30. Shaft 55 is, of course, suitably journalled for rotation within the frame 11, such as within cup 60 which is attached to support plate 59, with a suitable coupling being provided. With attention being briefly directed to FIG. 6 of the drawings, it will be seen that cup 60 is coupled to a pivotal bifurcated arrangement as at 60A. This view further illustrates the manner in which the worm gear drive mechanism accommodates modest arcuate shifting in response to the position adjust feature of the secondary belt tracking driver including spring 56.

Also, as is illustrated in FIG. 2, the bearings for yoke assembly formed by rocker support arm 20 along with bell cranks 21 and 22 are illustrated schematically, it being appreciated that tension adjustment is achieved by virtue of pivoting bell cranks 21 and 22 about axis of shaft 25. An adjustment shaft may be provided for the alignment of the device, if desired, with such an adjustment shaft being illustrated at 64. Furthermore, driver roll 13 is journalled within suitable bearings as at 67 and 68, with its shaft 33 being received therewithin. With continued attention being directed to FIG. 2, it will be observed that contact roll or drum 15 is journalled within suitable bearings formed in side plate or support 11A, with a bearing assembly being provided at each end of the shaft as at 62—62.

Figure 7:
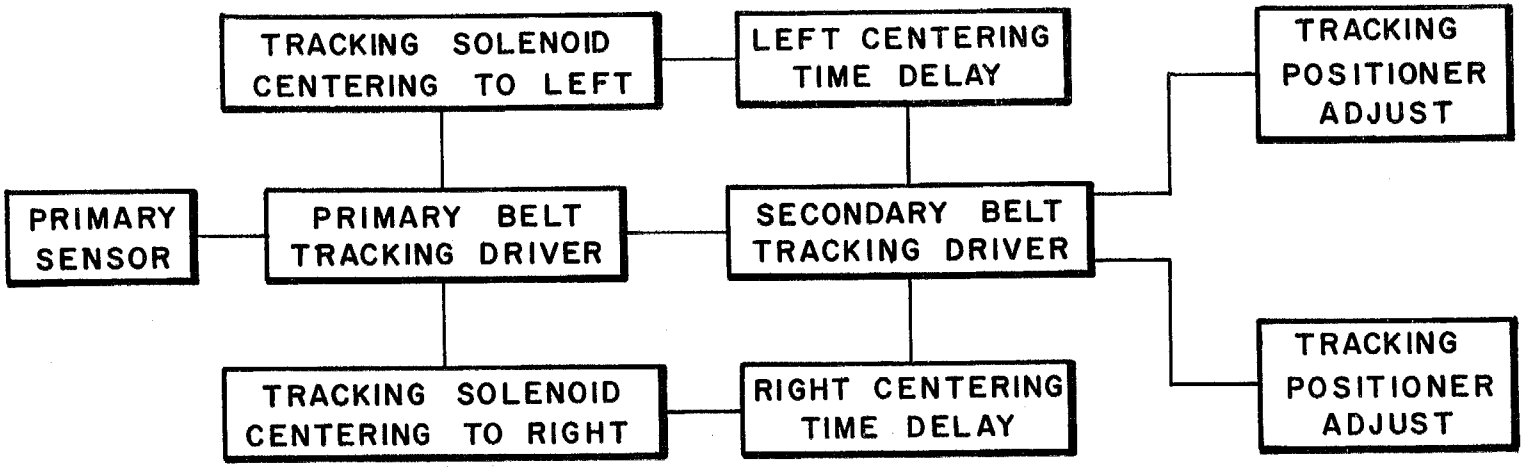
FIG. 7 is a block diagram illustrating, functionally, the inter-relationship between the primary sensor, the primary tracking driver, and the secondary tracking driver.
Figure 8:
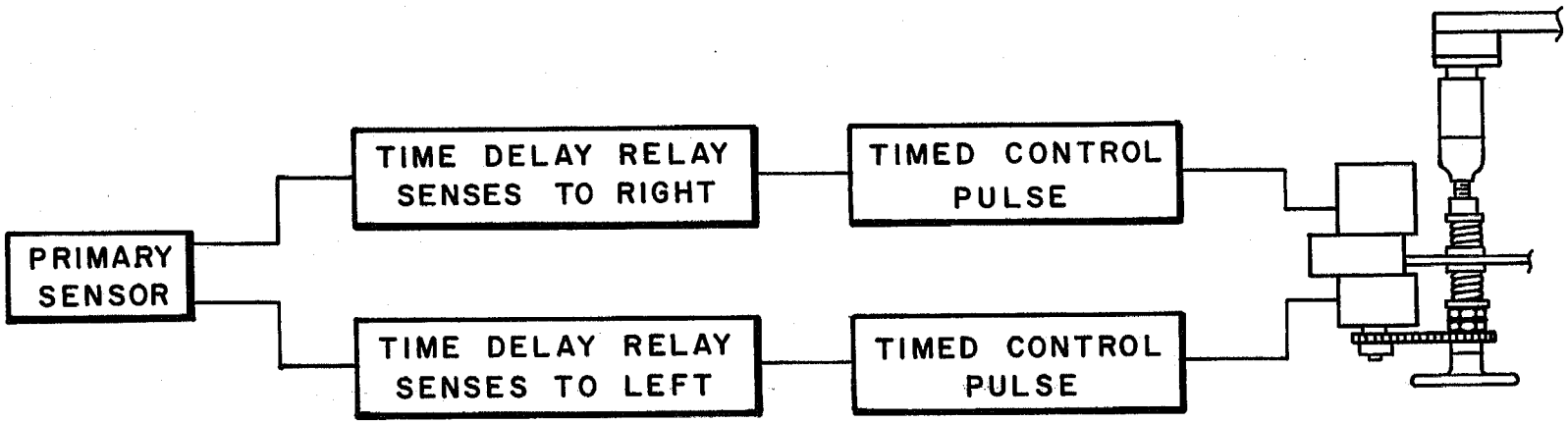
FIG. 8 is a block diagram illustrating the functional relationship between the primary and secondary tracking drivers, and illustrating the gear motors of the secondary tracking driver both functionally and in perspective.

Attention is now briefly directed to FIGS. 7 and 8 of the drawings, FIG. 7 illustrating a block diagram of the tracking system. FIG. 8 shows the tracking system in greater detail together with the arrangement to which the secondary belt tracking driver is responsive. As is apparent from the drawings, the primary belt tracking driver is arranged laterally on one side of rocker support arm 20, with the secondary belt tracking driver being arranged on the opposed side of pivot 30 from the primary belt tracking driver.

As has been indicated and shown in FIG. 2, secondary belt tracking driver 48 is in the form of a reversible gear motor 49, with motor 49 being actuated only after continuous actuation of the primary belt tracking driver for a certain predetermined interval of time. Whenever the primary belt tracking driver is actuated for a period of time exceeding the predetermined interval, such as for a period exceeding approximately one-half second, or alternatively up to about one second, the secondary belt tracking driver is actuated for a fixed period of time. The fixed period of time is preferably one which will achieve modest repositioning of the system without requiring a reverse adjustment immediately following the readjustment, thus avoiding a hunting operation. At any rate, for a tensioning and tracking roll having a length of approximately 30 inches, an axis readjustment of approximately 1/16 inch will normally be found to be effective. Such an arrangement is, of course, effective for those certain abrasive belts suited for substantially continuous operation in a wet environment on a metal grinding application, with such belts being commercially available. For belts having a lesser degree of tensile strength, a somewhat greater axis readjustment is ordinarily desirable. However, for most applications, a readjustment on a scale proportional to 1/16 inch for a 30-inch long tensioning and tracking roll will ordinarily be sufficient although readjustments of $\frac{1}{8}$ inch are useful.

By way of a time reference, the arcuate or pivotal motion of rocker support arm 20 which is derived from the normal motion of a pulse applied through solenoid valve 40 to piston 42 should be reduced by a factor of 4 in terms of the magnitude of the readjustment achieved by the secondary belt tracking driver. In other words, it has been found desirable that the tracking adjustment by the secondary belt tracking driver be approximately one-fourth of the amplitude used by the primary belt tracking driver. Such a relationship will in most instances, avoid the generation of a hunting operation.

As can be appreciated, to achieve extended control on the tracking of the endless abrasive belt, the direction of motion for the secondary belt tracking driver should be in the same direction, insofar as arcuate pivoting of rocker support arm 20 is concerned. Also, as has been indicated, the relationship of the magnitude of control is one by which the secondary driver achieves somewhere between, for example, one-tenth and one-half of the amplitude of movement required by the primary driver to achieve lateral movement of the endless belt to a desired extent. Stated another way, the extent of motion desired in the secondary belt tracking driver, once energized, should be sufficient to cause tracking of the endless belt to an extent equivalent to between about one-tenth to about one-half of the amplitude of the adjustment utilized by the primary belt tracking driver.

I claim:

1. In combination with a belt-type abrading machine comprising a frame, a drive roll and a belt tensioning and tracking roll, wherein said drive roll and belt tensioning and tracking roll drive an endless abrasive belt orbitally along a defined path; belt positioning means mounting said belt tensioning and tracking roll for pivotal motion about an axis arranged generally normal to the longitudinal axis of said tensioning and tracking roll to control the axial disposition of an orbitally moving endless belt mounted on said roll; said belt positioning means including a rocker support arm for journalably supporting said belt tensioning and tracking roll, with said belt tensioning and tracking roll being mounted upon said support arm; means mounting said support arm upon said frame for pivotal movement about an axis generally normal to the longitudinal axis of said belt tensioning and tracking roll, with said rocker support arm having segments extending laterally outwardly of the pivotal support axis therefor:

(a) first sensing means for determining the axial tracking disposition of said endless belt upon said rolls, and second sensing means responsive to the extent and direction of pivotal motion imparted to said support arm by said first sensing means;

(b) primary belt tracking drive means for reflecting the pivotal motion of said rocker support arm and responsive to signals from said first sensing means;

(c) secondary belt tracking drive means for effecting pivotal motion of said rocker support arm upon the continuous actuation of said primary belt tracking driver means for a certain predetermined time period, with said secondary belt tracking drive means being disposed in opposed relationship to said primary belt tracking drive means with respect to the rocker support arm pivot mount;

(d) said primary belt tracking drive means being operative to pivot said rocker support arm in either of two opposed arcuate directions for imparting lateral motion to an endless belt trained about said belt tensioning and tracking roll in response to a drive signal from said first sensing means, and with said secondary belt tracking drive means being operative to pivot said rocker support arm in the same arcuate direction as said primary belt tracking drive means whenever the duration of the drive signal of said first sensing means exceeds a predetermined magnitude.

* * * * *